United States Patent [19]

Jackson

[11] 4,050,639

[45] Sept. 27, 1977

[54] METHOD AND APPARATUS FOR ADVANCING STRAND

[75] Inventor: Robert R. Jackson, Aiken, S.C.

[73] Assignee: Owens-Corning Fiberglas Corporation, Toledo, Ohio

[21] Appl. No.: 646,740

[22] Filed: Jan. 5, 1976

[51] Int. Cl.[2] ..... B65H 54/02; B65H 54/86

[52] U.S. Cl. ..... 242/18 G; 28/279; 65/11 W; 226/190

[58] Field of Search ..... 242/18 G, 18 R, 47.01, 242/47.08, 47.09, 47.1, 47.11, 47.12, 47.03; 226/169, 181, 186, 187, 190, 193; 28/1.8, 72.15; 65/11 R, 11 W

[56] References Cited

U.S. PATENT DOCUMENTS

| | | | |
|---|---|---|---|
| 2,963,233 | 12/1960 | Riegler | 242/47.1 |
| 3,539,317 | 11/1970 | Smith | 65/11 W |

*Primary Examiner*—Stanley N. Gilreath
*Attorney, Agent, or Firm*—John W. Overman; Ronald C. Hudgens; Kenneth H. Wetmore

[57] ABSTRACT

Method and apparatus for advancing continuous glass strand during times the strand is not being collected into a package by a winder. A pair of cooperating rolls having a plurality of helical teeth are rotated to advance the strand therebetween.

8 Claims, 6 Drawing Figures

METHOD AND APPARATUS FOR ADVANCING STRAND

BACKGROUND OF THE INVENTION

Continuous filament glass strands may be produced by flowing a multiplicity of molten streams from a feeder containing a supply or body of molten glass and then applying a pulling force to the individual streams sufficient to attenuate the streams into continuous filaments, which are combined subsequently into a strand. A winder packages the strand on a collector such as a tube. The collector acts as the attenuating means through high speed rotation provided by the winder. When the required amount of strand winds into a package on the collector, the winder discontinues the rotation of the collector, which gives rise to an interruption in the attenuation of the glass filaments long enough to permit an operator to interchange an empty tube collector for the pull tube.

An interruption is detrimental to the process of forming continuous filament glass. The proper thermal conditioning of the molten glass for particular filament size and the like require strict adherence for uniformity of product; such conditioning tends to change during periods of interruption. Furthermore, if the filament attenuation is intermittent, the process must be started anew after each change of the collector. Such requires that an operator consume much time getting all the hundreds or even several thousands of streams of molten glass flowing properly from their feeder source by pulling the filaments over size applicators, gathering shoes and perhaps even strand splitters to ready the process to attenuate the streams into the filaments.

Thermal conditioning of the molten streams and the difficulty of properly flowing and attenuating all of the molten streams of glass into filaments arising from interruptions also pertains to the start-up of a cold feeder prior to collecting the first wound package after commencing operations.

Because the practice of having operators draw the filaments from the streams by hand at start-up and between packages was not satisfactory, there arose the practice of employing "secondary" means for advancing a strand such as cooperating rolls where one or both of the rolls are driven. Such a "secondary" means for advancing strand is shown and described in U.S. Pat. No. 3,539,317. During times of interruption the "secondary" means advance the strand to subsequently keep thermal continuity, etc.

"Secondary" means such as the cooperating rolls that have parallel teeth on the peripheral surfaces shown in U.S. Pat. No. 3,539,317 have been used in the industry for some time. With such prior art advancing means the strand must be securely placed between the rolls before the strand will be advanced by the rolls; that is, if a strand is laid at the end of the rolls it would not be advanced unless and until an operator positioned the strand between the rolls. When starting up or feeding these prior art rolls by dropping strand from above, it is necessary to have an operator take the strand dropped from above and place it between the rolls before the strand is advanced by the rolls. Thus, an operator who pushes or positions the strand between the rolls is necessary and critical to begin the advancement of the strand by the rolls. It would be desirable to have a method and apparatus for advancing strand wherein the placement of the strand between a set of pulling rolls is less dependent upon an operator.

Thus, it can be seen that improvement method and apparatus are needed.

SUMMARY OF THE INVENTION

The present invention includes method and apparatus for advancing continuous glass strand during times the strand is not being collected into a package by a winder. Cooperating rolls having a plurality of helical teeth are rotated to advance the strand therebetween.

An object of the invention is improved method and apparatus for advancing linear material.

Another object of the invention is improved method and apparatus which will "self feed" a strand between cooperating pull rolls for advancement of the strand by the rolls when the strand is brought into contact with the front portion of the cooperating rolls.

Another object of the invention is improved method and apparatus associated with a winder employed to advance linear material such as continuous filament glass strands in the filament forming process at times of operation during which there are interruptions in the collection of the strands or prior to collecting the first strand package at start-up.

These and other objects will become apparent as the invention is described hereinafter in detail with reference made to the accompanying drawings.

These drawings are generally illustrative of the method and apparatus for carrying out the invention but are not to be considered as limiting the invention to the specifics thereof.

DESCRIPTION OF THE PREFERRED EMBODIMENTS

While the invention is particularly valuable in processes for forming filaments of heat softened mineral material such as glass where individual continuous filaments are combined to form a strand prior to collecting the material as a wound package, the invention may be used in forming processes and subsequent manufacturing steps involving textile material from other fiber forming materials such as thermoplastic, chemical and natural fibers. Thus, the use of glass to explain the operation of the invention is by example only, the invention having utility in other textile operations.

Figure 1:
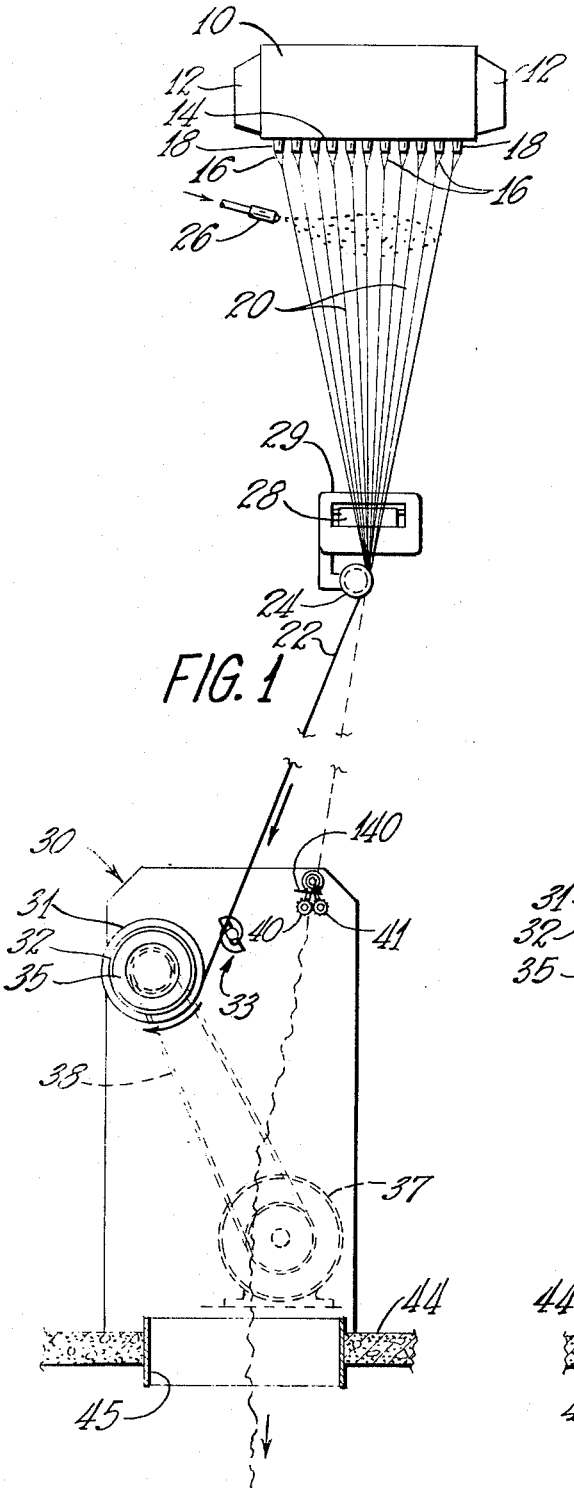
FIG. 1 is a somewhat diagramatic front elevation view of apparatus embodying the invention employed on a winder packaging continuous filament glass strand at a forming position. The dotted line indicates the path of the strand during times when the strand advances by the action of the apparatus according to the principles of the invention.
Figure 2:
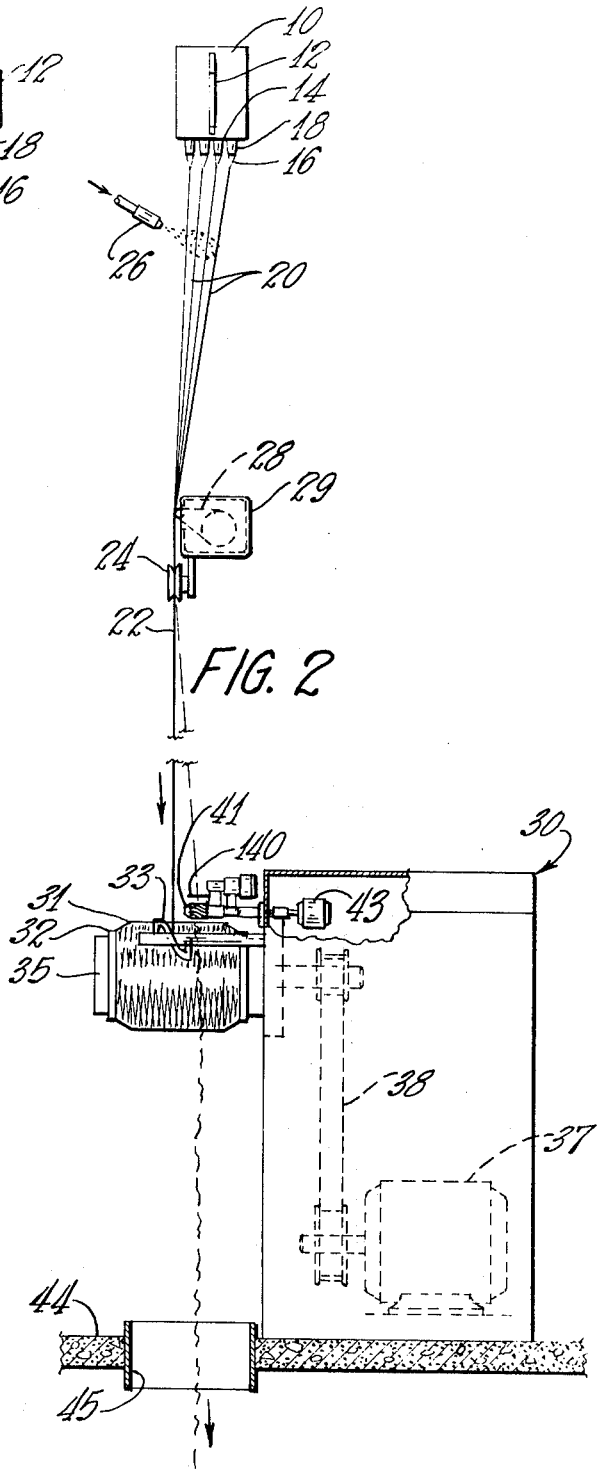
FIG. 2 is a side elevational view of the apparatus illustrated in FIG. 1.

FIGS. 1 and 2 show a process for forming continuous glass filaments from heat-softened glass where the glass filaments are combined into a strand, which is subsequently collected as a wound package. The FIGS. 1 and 2 illustrate a container or feeder 10 that holds the supply of molten glass. Container 10 may connect to a forehearth (not shown) that supplies molten glass from a furnace or may connect to a means for supplying glass (not shown) such as glass marbles that are reduced to a heat-softened condition and a melter or other means associated with the feeder or the container. Located at the ends of the container are terminals 12 that connect to a source of electrical energy to supply heat by conventional resistance heating to the glass held in the container to maintain the molten glass at a proper fiber forming temperature and viscosity. Moreover, the container has a bottom or tip section 14 that includes a plurality of orifices or passageways for delivering streams 7 of molten glass from the container. As shown, the openings in the bottom 14 comprise a plurality of depending orficed projections or tubular members 18.

The molten streams 16 are attenuated in individual continuous glass filaments 20 and combined into a strand 22 by a gathering shoe 24 located below the container.

While the filaments may be protected by only an application of water to them, it is desirable, in most instances, to apply to them a conventional size or other coating material. A nozzle 26 can be located near the bottom 14 to spray water onto the newly formed filaments, preferably prior to combining the filaments into strands 22. An applicator 28 supported within a housing 29 may be provided as shown in FIGS. 1 and 2 to apply the size or other coating material to the filaments. The applicator 28 may be any suitable means known in the art such as an endless belt that moves past the size or coating fluid held in housing 29. As the filaments pass across the surface of the applicator, some of the fluid material on the applicator transfers to them.

The strand 22 collects as a wound package 31 on a winder 30. Strand handling apparatus 33 moves the advancing strand 22 back and forth along the length of the package as the strand winds upon a collector such as tube 32 that has been telescoped over a spindle or collet 35, the collet being journaled for rotation on the winder 30. A motor 37 located within the housing 30 appropriately rotates the collet through a non-slipping belt 38. Appropriate conventional means (not shown) moves the strand handling apparatus 33.

While the apparatus of the invention shown in FIGS. 1 and 2 illustrates a process for attenuating continuous filaments of glass and subsequently combining them into a single strand 22, the invention may be employed with more than one strand.

Associated with the winder 30 is a "secondary" advancing means or "pull roll" assemblage suitable for advancing linear material such as glass strand 22. The apparatus as illustrated in FIGS. 1 and 2 functions during operating periods when the strand 22 does not wind on the tube 32. The assemblage includes a drive roll 40 and a cooperating idler roll 41 in working contact, the roll 40 being driven by a motor 43 located within the winder 30. During glass fiber forming operations such as start-up and between packages when the strand 22 does not collect as a package on the collet, an operator introduces the strand 22 by hand between the cooperating moving surfaces of the rollers 40 and 41, which rotate together to advance the strand 22 downwardly at a speed somewhat slower than the speed of attenuation. The strand 22 can travel at speeds of attenuation up to 10,000 feet per minute or faster. The rolls 40 and 41 advance the strand 22 into a scrap collection zone through an opening in the floor 44 such as a scrap chute 45 disposed below the rollers. The dotted line in FIGS. 1 and 2 indicate a strand path from the rollers 40 and 41 to the scrap chute 45. The strand 22 directed through the scrap chute 45 collects in a container (not shown) for succeeding disposal.

Figure 3:
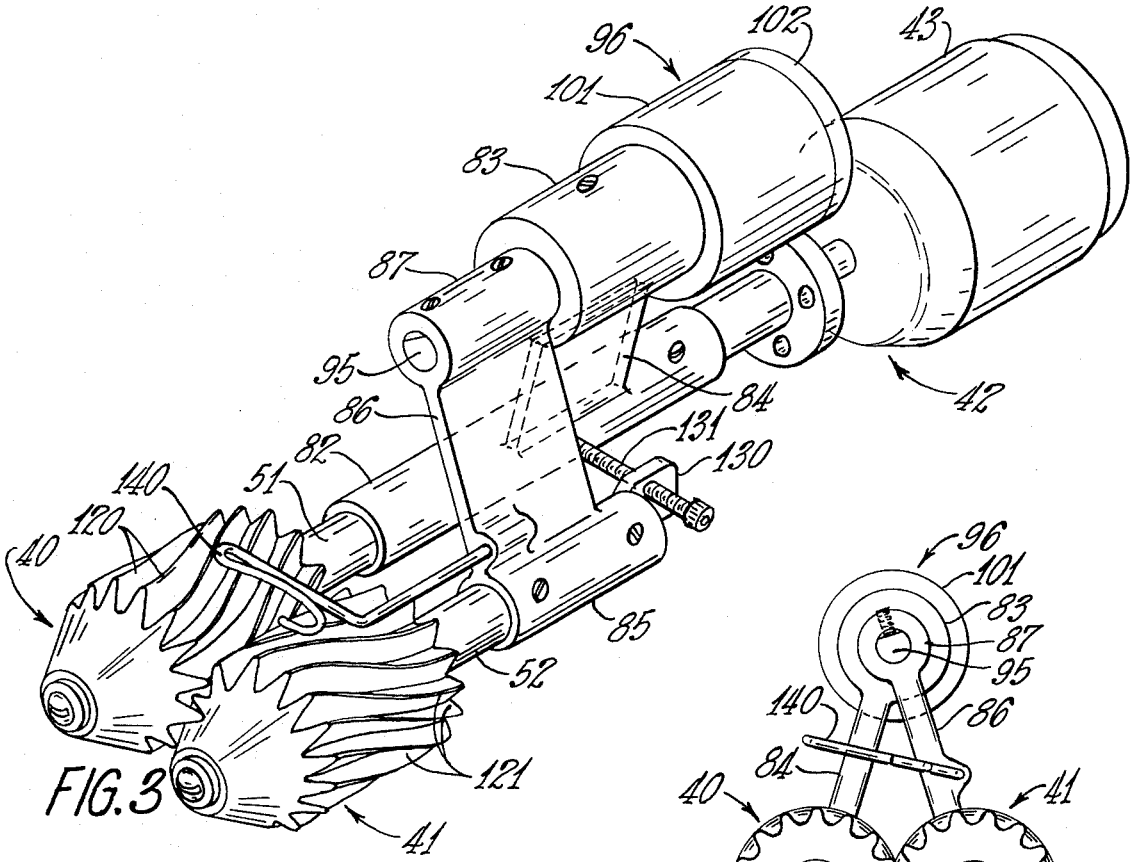
FIG. 3 is an enlarged perspective view of apparatus for advancing linear material according to the principles of the invention that appears in FIGS. 1 and 2.
Figure 4:
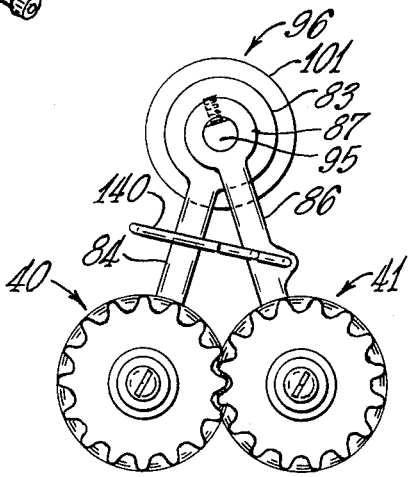
FIG. 4 is an end elevation view of the apparatus illustrated in FIG. 3.

Referring to FIGS. 3 and 4 the drive unit 42, in a sense, is a cantilever unit that includes support structure and a drive system. The roll 40 is driven by the motor 43 through the drive tube system 51. Suitable drive system means are illustrated and discussed in detail in U.S. Patent No. 3,539,317. Such U.S. Patent is hereby incorporated by reference. The idler roll 41 is rotatably mounted on the end of support means 52. Suitable support means for the roller 41 are discussed in the above referenced U.S. Patent.

Referring to FIGS. 3 through 6, the connecting arrangement between the drive unit and the idler unit is a hinged unit comprising several parts. The drive tube 51 is rotatably held by the tubular means 82. The tubular means is supported by the support means 83 through the connecting member 84. The idler unit support tube 52 is similarly held by tubular means 85. The tubular means 85 is supported by the support means 87 through the connecting member 86. A spring rod 95, which is a part of a means for lightly urging or biasing the idler rolls 41 against the driven roll 40, extends through the tubular supports 83 and 87. The tubular supports 83 and 87 move about the axis of rotation of the rod 95 in a hinge like fashion.

Associated with the connecting arrangement is a load assembly 96 that yieldably urges or biases the idler roll 41 into light pressing relationship with the driven roll 40. The load assembly 96 includes a spring drum 101, a drum cap 102, a load spring 104, a screw 105 and the spring rod 95. This load assembly 96 is explained in detail in the referenced U.S. Pat. No. 3,539,317.

Figure 5:
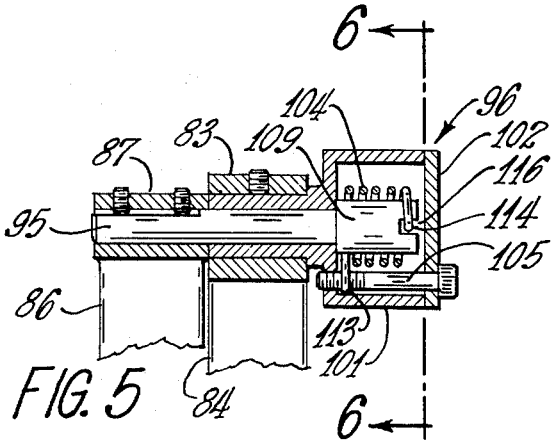
FIG. 5 is a view in longitudinal section of that portion of the apparatus shown in FIG. 3 that provides the lightly biasing or urging force pressing the tooth rolls together according to the principles of the invention.
Figure 6:
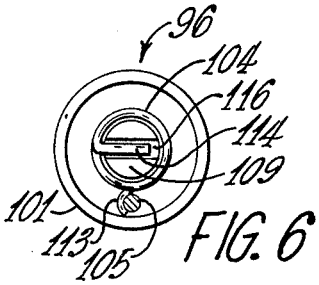
FIG. 6 is a section taken along the lines 6—6 in the direction of the arrows and shows a spring employed with the apparatus according to the principles of the invention.

As illustrated in FIGS. 5 and 6, the load spring 104 acts on the spring rod 95 to press or urge the idler roll 41 toward the driven roll 40 into lightly pressed relation with it. As shown the load spring 104 includes a radially outwardly extending end 113 and an inwardly extending portion 114 and is of suitable size to fit over the larger end 109 of the rod 95. The inwardly extending portion 114 of the spring 104 fits into a slot or passageway 116 fashioned at the outer end of the portion 109. The screw 105, which extends through the working chamber 103 of the spring drum 101, provides a surface against which the radially outwardly extending portion 113 of the spring 104 may contact. Movement of the spring drum 101 about its axis of rotation loads the spring 104, which gives rise to tortional forces in the spring rod 95 that moves the idler roll 41 toward the driven roll 40 in lightly urged-together relationship.

The driven roll 40 and the idler roll 41 are longitudinal or cylindrical members that have helical gear-like peripheral surfaces comprising helical teeth 120 and 121 respectively. Thus, in a sense, the rolls 40 and 41 are helical gears where the teeth 120 and 121 are longitudinal members or ribs extending radially from the periphery of the rolls.

In practice the teeth 120 and 121 generally have a helical angle which is in the range of about negative 10 to about negative 40 degrees from the horizontal as viewed from the side of the "pull roll" assemblage. Teeth having a negative helical angle of about 30 degrees are preferred. The "pull roll" assemblage shown in FIG. 3 has a negative helical angle.

The rolls 40 and 41 normally have a small number from about 12 to about 16 large size teeth. These teeth are rounded at the outer ends or edges to preclude chewing the glass strand as the teeth cooperate to engage the strand to advance it.

It is important that the helical angle of the teeth of the rolls 40 and 41 is negative from the horizontal. This negative helix angle is clearly shown in FIG. 3. In the area of cooperation between the rolls, the teeth helically move upwardly from the nose or front end of the roll to the back end of the roll. Because the rolls 40 and 41 have a negative helical angle, a strand contacting the front or nose portion between the rolls will be automatically urged by the helical rolls to move laterally along and between the rolls from the nose or front portion of the rolls toward the rear portion of the rolls. A guide means 140 is located at the back, or rear end, region of the rolls. The guide means 140 is located such that the strand is advanced laterally along the rolls into contact with the guide means so that the strand is then guided by the guide means 140. Thus, strand being engaged at the front portion of the roll 40 and 41 will be advanced downwardly and also will be urged to move laterally along the gears from the front portion of the rolls to the rear portion of the rolls into guiding relationship with the guide member 140.

So, with the helical roll advancing means an operator up at the feeder level of a glass fiber forming operation can drop a strand down from the feeder and have it begin its advancement by the helical rolls by merely directing the strand into contact with the nose area of the cooperating rolls.

Although the rolls 40 and 41 are maintained in lightly urged together relationships, the apparatus employs means precluding normal or full meshing engagement of the teeth 120 and 121. As clearly shown in FIG. 3, the tubular member 85 has a mounting extension 130 with a threaded opening through which an adjusting screw 131 threads. When the apparatus of the invention is in operating position, the threaded end of the screw 131 abuts against the surface of the tubular member 82, which is disposed on the drive tube 51. While the screw 131 can turn to laterally position the roll 41 closer to or further from the roll 40 to permit more or less engagement of the teeth 120 and 121 for particular strand sizes, in practice the apparatus normally operates with the teeth 120 and 121 extending for working contact from about ½ to about ⅔ the depth of the space between the teeth. As illustrated in FIG. 4, such modified tooth penetration leaves considerable clearance between the rounded ends or edges of the teeth (120, 121) and the bottom of the spaces.

Having described the invention in detail, it will be understood that such specifications are given for the sake of explanation. And various modifications and substitutions other than those cited may be made without departing from the scope of the invention as described in the following claims.

I claim:

1. In an apparatus for advancing continuous glass strand wherein a winder collects the strand into a wound package, wherein a pair of rotatable rolls cooperate to advance the strand therebetween during times the strand is not collected on the winder and wherein at least one of the rolls is rotatably driven, the improvement comprising:

a plurality of helical teeth extending outwardly from each of the rolls adapted to concurrently advance the strand from the rolls and move the strand laterally between the rolls.

2. The apparatus of claim 1 including means yieldably urging the rolls toward each other.

3. The apparatus of claim 1 including means for establishing a predetermined meshing relationship with the rolls.

4. The apparatus of claim 1 wherein the helical teeth of each roll have a negative angle from the axis of rotation of the roll, said negative angle being in the range of about 10° to about 40°.

5. The apparatus of claim 1 including guide means at the rolls such that the strand being advanced by the rolls is moved laterally between the rolls to the guide means so that the strand and the guide means are in guiding relationship.

6. The apparatus of claim 1 wherein each roll has about 16 helical teeth.

7. Apparatus for advancing continuous glass strand comprising:

a winder for collecting the strand as a wound package; and interim means for advancing the strand during times the winder is not collecting the strand, the interim means comprising a pair of cooperating rotatable rolls, at least one of the rolls being driven, each of the rolls having about sixteen helical teeth extending from the outer surface thereof and adapted to advance the strand positioned therebetween, the helical teeth of each roll being at a negative angle of about 30° from the axis of rotation of the roll.

8. A method for advancing continuous glass strand comprising:

introducing the strand between a pair of cooperating rotatable rolls, the rolls having a plurality of helical teeth; and rotating said rolls to concurrently advance the strand from the rolls and move the strand laterally between the rolls to a guide means.

* * * * *